United States Patent [19]

McWilliams

[11] Patent Number: 4,665,307

[45] Date of Patent: May 12, 1987

[54] THERMAL CUT-OUT DEVICE FOR RADIANT HEATERS

[75] Inventor: Joseph A. McWilliams, Droitwich, England

[73] Assignee: Micropore International Limited, Droitwich, United Kingdom

[21] Appl. No.: 732,758

[22] PCT Filed: Sep. 7, 1984

[86] PCT No.: PCT/GB84/00308

§ 371 Date: May 8, 1985

§ 102(e) Date: May 8, 1985

[87] PCT Pub. No.: WO85/01412

PCT Pub. Date: Mar. 28, 1985

[30] Foreign Application Priority Data

Sep. 10, 1983 [GB] United Kingdom ..... 8324271

[51] Int. Cl.[4] ..... H05B 3/68

[52] U.S. Cl. ..... 219/449; 219/461; 219/443; 219/462; 219/512; 337/394

[58] Field of Search ..... 219/449, 461, 464, 443, 219/354, 405, 411, 446, 460, 462, 468, 512; 337/393, 394, 382, 386

[56] References Cited

U.S. PATENT DOCUMENTS

| | | | |
|---|---|---|---|
| 2,559,372 | 7/1951 | Rike | 337/394 |
| 2,626,755 | 1/1953 | Tidd | 337/382 |
| 3,710,076 | 1/1973 | Frazier | 219/449 |
| 3,883,719 | 5/1975 | Hurko | 219/464 |
| 4,267,815 | 5/1981 | Gössler | 337/394 |

FOREIGN PATENT DOCUMENTS

| | | | |
|---|---|---|---|
| 0037638 | 10/1981 | European Pat. Off. . | |
| 0116861 | 8/1984 | European Pat. Off. . | |
| 735491 | 5/1943 | Fed. Rep. of Germany . | |
| 2435796 | 4/1980 | France . | |
| 2522119 | 8/1983 | France . | |
| 272598 | 12/1950 | Switzerland . | |
| 2069300 | 8/1981 | United Kingdom | 219/449 |

*Primary Examiner*—George H. Miller, Jr.
*Assistant Examiner*—Teresa J. Walberg
*Attorney, Agent, or Firm*—Browdy and Neimark

[57] ABSTRACT

A thermal cut-out device for a radiant heater includes a probe-type thermally responsive assembly (2), at least a part of which is coated with and/or is surrounded by a radiation reflective material. The probe-type assembly may include a first element (3) in the form of a rod of material having a relatively high coefficient of thermal expansion and a second element (4) in the form of a tube of material having a relatively low coefficient of thermal expansion. The rod may be coupled to a snap-acting switch assembly (1). One or both of the first and second elements may be coated with or surrounded by the radiation reflective material. Alternatively the tube which surrounds the first element may be made of the radiation reflective material. The radiation reflective material may be a metal such as gold or a suitable element from Group VIII of the Periodic Table or may be a high temperature resistant particulate material such as aluminium oxide, magnesium oxide, titanium dioxide or tin oxide.

37 Claims, 11 Drawing Figures

THERMAL CUT-OUT DEVICE FOR RADIANT HEATERS

The present invention relates to thermal cut-out devices for radiant heaters and to radiant heaters incorporating such thermal cut-out devices.

In a radiant heater, for example for a glass ceramic top cooker, thermal energy emitted by an electric heating element or by an infra-red lamp is transmitted, partly by convection and conduction and partly by radiation, to and through the glass ceramic and is absorbed by a cooking utensil positioned on the cooking surface above the heater. It is conventional in such heaters to include a thermal cut-out device to prevent the exposed surface of the glass ceramic rising above about 600° C. which could cause damage to or discolouration of the cooking surface. We have found, however, that under certain circumstances the thermal cut-out device can be caused to operate at an undesirably low temperature due to incident radiation.

It is therefore an object of the present invention to provide a thermal cut-out device which is less sensitive to incident thermal radiation. It is a further object of the present invention to provide a radiant heater which incorporates such a thermal cut-out device.

According to one aspect of the present invention there is provided a thermal cut-out device for a radiant heater, which thermal cut-out device comprises a probe-type thermally responsive assembly, characterised in that at least a part of the thermally responsive assembly is coated with and/or is surrounded by a radiation reflective material.

According to a further aspect of the present invention there is provided a radiant heater, for example for a glass ceramic top cooker, which heater comprises at least one heating element and a thermal cut-out device comprising a probe-type thermally responsive assembly which extends across the heater, characterized in that at least a part of the thermally responsive assembly is coated with and/or is surrounded by a radiation reflective material.

The heating element, for example, may be in the form of a helically coiled bare wire or may be an infra-red lamp. The heating element may be arranged on a base layer of thermally insulating material or may be supported above a reflector. A peripheral wall of thermal insulation material may surround the at least one heating element.

In one embodiment of the present invention, the thermal cut-out device includes a snap-acting switch assembly and the probe-type assembly comprises a first element of material having a relatively high coefficient of thermal expansion and a second element of material having a relatively low coefficient of thermal expansion, one of which elements is coupled with the snap-acting switch assembly.

Preferably, the thermally responsive assembly comprises a metal rod coupled with the snap-acting switch assembly and arranged within a high temperature resistant glass tube.

The metal rod may be coated with a metal such as gold or a suitable element from Group VIII of the Periodic Table, or with a high temperature resistant powder, for example a metal oxide such as aluminum oxide, magnesium oxide, titanium dioxide or tin oxide. Additionally, or alternatively, the glass tube may be coated with metal or metal foil or, preferably, coated at least partly with a suitable powder. Instead of, or in addition to, coating the metal rod or the glass tube, a radiation reflective barrier may be positioned between the metal rod and the glass tube and/or may be positioned around the glass tube. Such a barrier may be made of or may be coated with a metal such as gold or a suitable element from Group VIII of the Periodic Table or may be made of or coated with a powder such as aluminium oxide, magnesium oxide, titanium dioxide or tin oxide. For example, gold in liquid form or as a paste may be coated onto a ceramic tube made of a material such as magnesium silicate.

Instead of providing a radiation reflective barrier, the tube itself may be made of a radiation reflective particulate material.

Where the barrier or the tube is made of or coated with a powder, the particle size of the powder is preferably of the order of the wavelength of the incident radiation. For most applications in radiant heaters, a particle size of about 1 to 2 microns is suitable. The shape of the particles is preferably relatively spherical.

The barrier or the tube is substantially opaque to incident radiation and where the particles are coated onto a substrate the thickness of the coating is preferably such as to give a depth of at least six particles.

Further, the powder material itself is preferably an effective scatterer of incident radiation. We have found that relatively pure alumina, such as a material containing about 80 to 99 percent by weight alumina, is particularly suitable. A small proportion of a bonding agent such as silica may be added to or incorporated in the alumina particles.

The particles may, for example, be formed into a tube, or may be coated, e.g. by spraying, onto at least a part of the thermally responsive assembly such as all or part of the glass tube and/or all or part of the metal rod.

Where the particles of the powder require to be bonded to each other, this should be effected without significantly affecting the discrete nature of the particles. For example, where the bonding is effected by firing, the particulate material may be underfired. For alumina, the firing temperature is preferably in the range of from 1200° to 1400° C., most preferably about 1350° C. The firing time may be between about 10 minutes and 1 hour.

For a better understanding of the present invention and to show more clearly how it may be carried into effect reference will now be made, by way of example, to the accompanying drawings in which.

Figure 1:
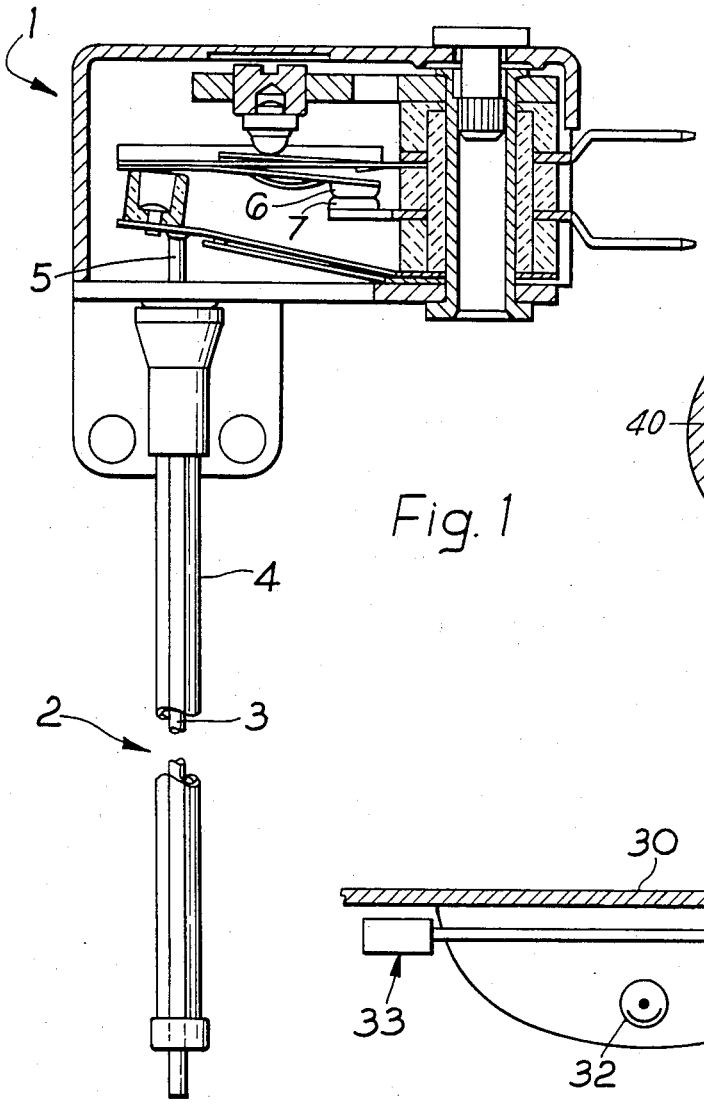
FIG. 1 is a view of a known thermal cut-out device which can be used with a radiant heater.
Figure 2A:
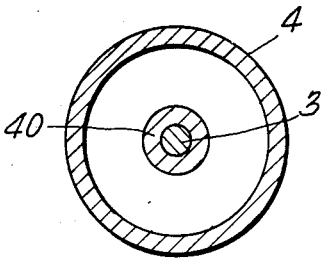
FIG. 2 shows a radiation reflective barrier between a metal rod and a glass tube of the thermal cut-out device.
Figure 9:
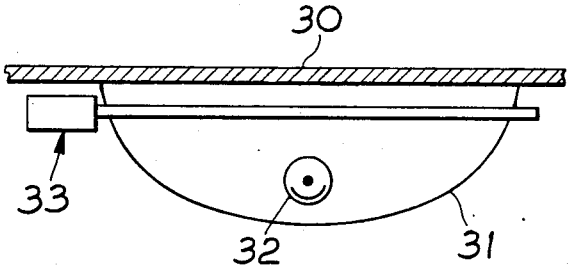
Figure 3A:
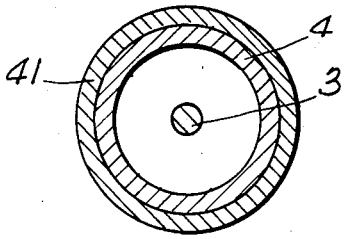
Figure 3:
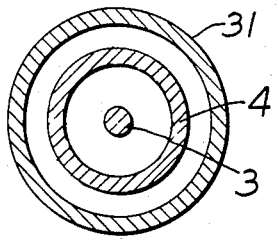
Figure 4:
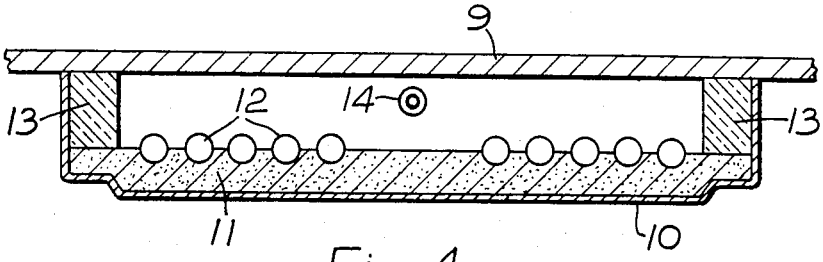
Figure 5:
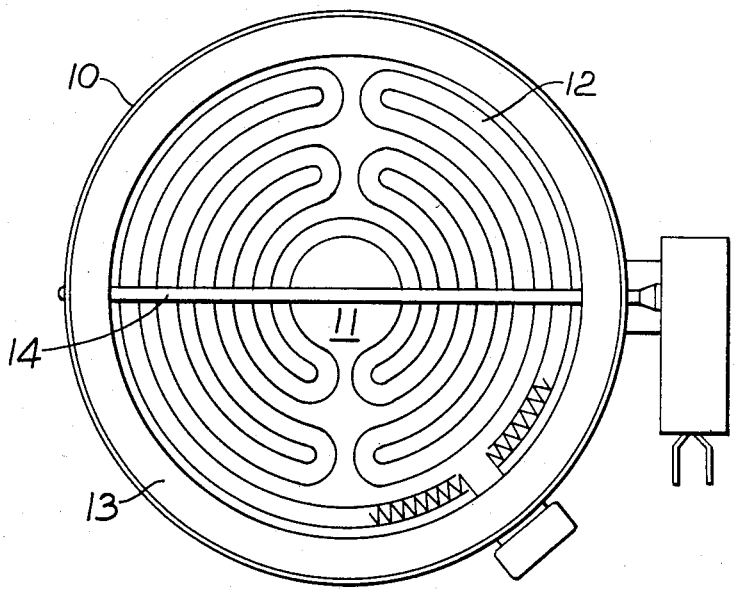
Figure 6:
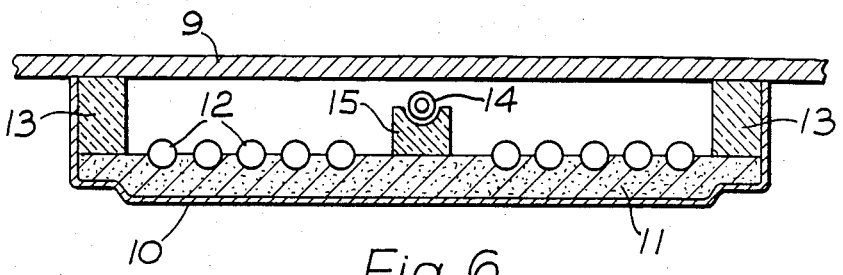
Figure 7:
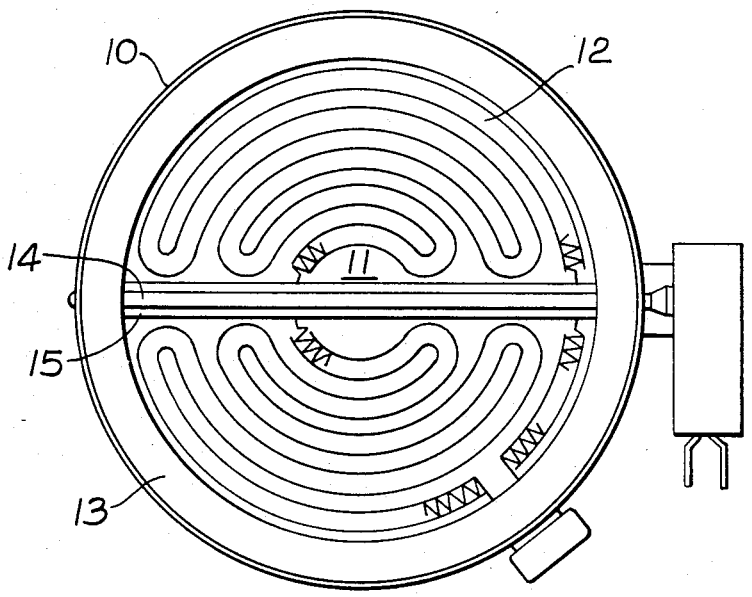
Figure 8:
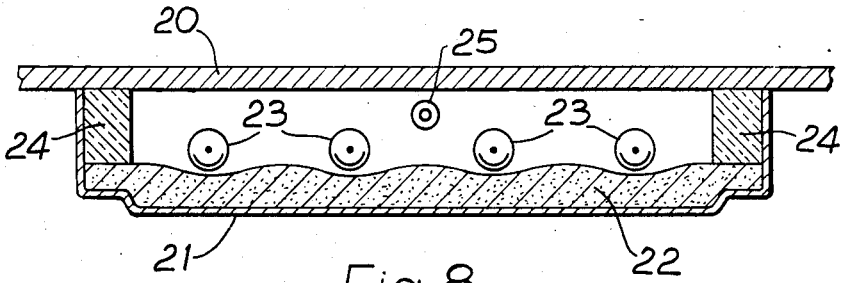

FIG. 2*a* shows a radiation reflective coating on a metal rod, with the coated metal rod being positioned within a glass tube of the thermal cut-out device;

FIG. 3 shows a radiation reflective barrier around the glass tube of the thermal cut-out device;

FIG. 3*a* shows a radiation reflective coating on the glass tube of the thermal cut-out device of the present invention;

FIG. 4 is a cross-sectional view of a radiant heater which incorporates the thermal cut-out device of FIG. 1;

FIG. 5 is a plan view of the heater shown in FIG. 4;

FIG. 6 is a cross-sectional view of an alternative embodiment of a radiant heater;

FIG. 7 is a plan view of the heater shown in FIG. 6;

FIG. 8 is a cross-sectional view of one embodiment of a heater which incorporates infra-red lamps; and FIG. 9 is a cross-sectional view of another embodiment of a heater which incorporates infra-red lamps.

FIG. 1 shows a thermal cut-out device for a radiant heater, the thermal cut-out device being sold under the designation 16T by Therm-O-Disc Incorporated of 1320 S Main Street, Mansfield, Ohio 44907, U.S.A.

The thermal cut-out device is of the probe-type and comprises a snap-acting switch assembly 1 and a thermal actuator 2. The thermal actuator 2 comprises a metallic rod 3 having a relatively high coefficient of thermal expansion positioned within a tube 4 of glass having a relatively low coefficient of thermal expansion. Thus, when the probe is heated the end 5 of the rod moves so as operate the snap-acting switch assembly 1 at a predetermined temperature and to separate the contacts 6,7 and cut off the supply of electrical energy to the heating element (not shown in FIG. 1).

We have found that the sensitivity of the cut-out device to incident radiation is considerably reduced if the metallic rod is coated with a reflective material. Suitable reflective materials include metals which are not readily oxidized at the temperatures encountered (about 600° to 800° C.) such as gold and suitable metals form Group VIII of the Periodic Table, for example platinum and iridium, or powders which are stable at the temperature encountered, for example metal oxides such as aluminium oxide, magnesium oxide, titanium dioxide and tin oxide.

As an alternative, or in addition, the glass tube 4 may be partly or entirely coated with a reflective material. It is, however, relatively expensive to coat glass with metals or metal foils and in this situation it is generally preferable to coat the glass with a powder. Further, the tube 4 may be made of a material other than glass, which material is radiation reflective.

Figure 2:
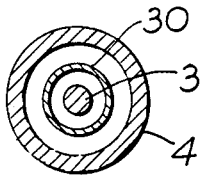

FIG. 2 is a cross-sectional view of the probe of the thermal cut-out device and shows a radiation reflective barrier 30 positioned between the metal rod 3 and the glass tube 4.

FIG. 2*a* is a cross-sectional view of the probe of the thermal cut-out device and shows a radiation reflective coating 40 on the metal rod 3, with the coated metal rod being positioned within the glass tube 4.

FIG. 3 is a similar view to that shown in FIG. 2, but shows a radiation reflective barrier 31 positioned around the glass tube 4.

FIG. 3*a* is a cross-sectional view of the probe of the thermal cut-out device similar to that shown in FIG. 3, but with a radiation reflective coating 41 on the outer surface of the glass tube 4.

If desired, the thermaal cut-out device may incorporate both radiation barriers 30 and 31. In addition, the metal rod 3 and/or the glass tube 4 may be coated with a radiation reflective material. The radiation barrier may be made of or coated with a metal such as gold or a suitable element from Group VIII of the Periodic Table, but is preferably made of or coated with a powder such as aluminium oxide, magnesium oxide, titanium dioxide or tin oxide. The particles are preferably relatively spherical in shape and have a size of about 1 to 2 microns, that is to say a size of the order of the wavelength of the incident radiation to be reflected.

The particles may be coated onto a substrate, but the barrier should be opaque to incident radiation. In this respect, a coating to a depth of at least six particles is preferred.

The powder itself is preferably an effective scatterer of incident radiation. For example, relatively pure alumina, such as a material containing about 80 to 99 percent by weight alumina, is suitable. A small proportion of a bonding agent such as silica may be added to or incorporated in the alumina particles.

Where the particles of the powder require to be bonded to each other, for example in order to make a handleable tube, this should be carried out without significantly affecting the discrete nature of the particles. This may be accomplished by firing. However, we have found that normal firing temperatures result in significant agglomeration of the particles which reduces their reflective properties. We have found that if the particles are underfired sufficient strength can still be imparted without causing excessive agglomeration. For alumina, the normal firing temperature is about 1450° C., but we have found that satisfactory radiation reflecting tubes can be produced if the firing temperature is in the range of 1200° to 1400° C., preferably about 1350° C. The firing time may vary between about 10 minutes and 1 hour, with shorter times being preferred at higher temperatures.

The heater shown in FIGS. 4 and 5 is arranged beneath a glass ceramic cooking top 9 and comprises a metal dish 10 containing a base layer 11 of thermal insulation material which is formed with a pattern of grooves. Arranged in the grooves is a heating element 12 in the form of a coil of bare wire which may be secured in place, for example, by means of staples (not shown). A peripheral wall 13 of thermal insulation material surrounds the heating element 12. A thermal cut-out device 14 extends across the heater and is treated as described above to counteract the effects of incident radiation.

The heater shown in FIGS. 6 and 7 is similar to the one shown in FIGS. 4 and 5 and the same reference numerals are employed to denote similar parts. However, the heater shown in FIGS. 6 and 7 incorporates a radiation shield 15 which at least partly protects the thermal cut-out device from direct radiation from the heating element. The radiation shield may be moulded as part of the base layer of insulation material or may be a separate shield made, for example, from ceramic fibre. The thermal cut-out device runs along a groove formed in the upper surface of the shield in order to give maximum protection from direct radiation. However, it will be noted that the thermal cut-out device does not contact the underside of the glass ceramic cooking top 9 and neither does the shield 15. Contact with the cooking top 9 is avoided in order that the heater should be as unobtrusive as possible through the glass ceramic, because contact with the glass ceramic can produce unsightly dark patches, and in order to avoid de-coupling the thermal cut-out device too effectively from the temperature of the surrounding air.

FIG. 8 shows an alternative embodiment of a radiant heater arranged beneath a glass ceramic cooking top 20. The heater comprises a metal dish 21 containing a base layer 22 of thermal insulation material in which there is formed a plurality of shallow depressions. Arranged in each of the depressions is an infra-red lamp 23. A peripheral wall 24 of thermal insulation material surrounds the lamps, and a thermal cut-out device 25 which is treated to counteract the effects of incident radiation extends across the heater. As with the embodiment of FIGS. 6 and 7, a radiation shield (not shown)

may be used to protect the thermal cut-out device from direct radiation from the lamps 23.

FIG. 9 shows a further embodiment of a radiant heater arranged beneath a glass ceramic cooking top 30. The heater comprises a reflector bowl 31 having supported therein an infra-red lamp 32. A thermal cut-out device 33 which is treated to counteract the effects of incident radiation extends across the heater. The reflector bowl 31 may have a backing of thermal insulation material.

We have found that if a radiant heater is equipped with a thermal cut-out device which is treated to counteract the effects of incident radiation, a significant reduction can be achieved in the number of times the heating element, that is the wire element, or the infra-red lamp or lamps, is turned off unnecessarily.

I claim:

1. A thermal cut-out device for a radiant heater, comprising:

a snap-acting switch assembly, and a probe-type thermally responsive assembly, comprising:

a metal rod made from a material having a relatively high coefficient of thermal expansion, the metal rod being coupled with the snap-acting switch assembly, which metal rod is coated with a reflective metal; and a high temperature resistant glass tube positioned around said metal rod, said glass tube being made from a material having a relatively low coefficient of thermal expansion.

2. A thermal cut-out device according to claim 1, wherein the reflective metal is selected from the group consisting of gold and an element from Group VIII of the Periodic Table.

3. A thermal cut-out device for a radiant heater, which thermal cut-out device comprises a snap-acting switch assembly and a probe-type thermally responsive assembly comprising:

a metal rod made from a material having a relatively high coefficient of thermal expansion, the metal rod being coupled with the snap-acting switch assembly, said metal rod being coated with a reflective high temperature resistant particulate material; and a high temperature resistant glass tube positioned around said metal rod, said glass tube being made from a material having a relatively low coefficient of thermal expansion.

4. A thermal cut-out device according to claim 3, wherein said high temperature resistant particulate material comprises a metal oxide.

5. A thermal cut-out device according to claim 4, wherein said metal oxide is selected from the group consisting of aluminium oxide, magnesium oxide, titanium dioxide and tin oxide.

6. A thermal cut-out device for a radiant heater, which thermal cut-out device comprises a snap-acting switch assembly and a probe-type thermally responsive assembly comprising:

a metal rod made from a material having a relatively high coefficient of thermal expansion, the metal rod being coupled with the snap-acting switch assembly;

a high temperature resistant glass tube positioned around said metal rod, said glass tube being made from a material having a relatively low coefficient of thermal expansion; and a radiation reflective barrier positioned between said metal rod and said glass tube.

7. A thermal cut-out device according to claim 6, wherein said radiation reflective barrier is made of a metal.

8. A thermal cut-out device according to claim 7, wherein the metal is selected from the group consisting of gold and an element from Group VIII of the Periodic Table.

9. A thermal cut-out device according to claim 6, wherein said radiation reflective barrier is coated with a metal.

10. A thermal cut-out device according to claim 9, wherein the metal is selected from the group consisting of gold and an element from Group VIII of the Periodic Table.

11. A thermal cut-out device according to claim 6, wherein said radiation reflective barrier is made of a high temperature resistant particulate material.

12. A thermal cut-out device according to claim 11, wherein the particulate material comprises a metal oxide.

13. A thermal cut-out device according to claim 12, wherein the metal oxide is selected from the group consisting of aluminium oxide, magnesium oxide, titanium dioxide and tin oxide.

14. A thermal cut-out device according to claim 11, wherein the particulate material has a particle size of from 1 micron to 2 microns.

15. A thermal cut-out device according to claim 11, wherein the particulate material consists of substantially spherical particles.

16. A thermal cut-out device according to claim 14, wherein the particulate material comprises from 80 to 99 percent by weight of alumina.

17. A thermal cut-out device according to claim 16, wherein the particulate material includes a bonding agent.

18. A thermal cut-out device according to claim 17, wherein the bonding agent comprises silica.

19. A thermal cut-out device according to claim 16, wherein the particulate material is fired at a temperature in the range from 1200° to 1400° C.

20. A thermal cut-out device according to claim 19, wherein the particulate material is fired at a temperature of substantially 1350° C.

21. A thermal cut-out device according to claim 19, wherein the particulate material is fired for a time between substantially 10 minutes and 1 hour.

22. A thermal cut-out device according to claim 6, wherein the radiation reflective barrier is coated with a high temperature resistant particulate material.

23. A thermal cut-out device according to claim 22, wherein the particulate material comprises a metal oxide.

24. A thermal cut-out device according to claim 23, wherein the metal oxide is selected from the group consisting of aluminium oxide, magnesium oxide, titanium dioxide and tin oxide.

25. A thermal cut-out device for a radiant heater, which thermal cut-out device comprises a snap-acting switch assembly and a probe-type thermally responsive assembly comprising:

a metal rod made from a material having a relatively high coefficient of thermal expansion, the metal rod being coupled with the snap-acting switch assembly; and a high temperature resistant glass tube positioned around the metal rod, the glass tube being made from a material having a relatively low coefficient of thermal expansion and having a coating selected from the group consisting of a reflective metal, a reflective metal foil and a reflective high temperature resistant particulate material.

26. A thermal cut-out device according to claim 25, wherein the reflective metal is selected from the group consisting of gold and an element from Group VIII of the Periodic Table.

27. A thermal cut-out device according to claim 25, wherein the high temperature resistant particulate material comprises a metal oxide.

28. A thermal cut-out device according to claim 27, wherein the metal oxide is selected from the group consisting of aluminium oxide, magnesium oxide, titanium dioxide and tin oxide.

29. A thermal cut-out device for a radiant heater, which thermal cut-out device comprises a snap-acting switch assembly and a probe-type thermally responsive assembly comprising:

a metal rod made from a material having a relatively high coefficient of thermal expansion, the metal rod being coupled with the snap-acting switch assembly; and a tube of radiation reflective particulate material positioned around the metal rod, the tube being made from a material having a relatively low coefficient of thermal expansion.

30. A thermal cut-out device according to claim 29, wherein the particulate material has a particle size of from 1 micron to 2 microns.

31. A thermal cut-out device according to claim 30, wherein the particulate material consists of substantially spherical particles.

32. A thermal cut-out device according to claim 30, wherein the particulate material comprises from 80 to 99 percent by weight of alumina.

33. A thermal cut-out device according to claim 32, wherein the particulate material includes a bonding agent.

34. A thermal cut-out device according to claim 33, wherein the bonding agent comprises silica.

35. A thermal cut-out device according to claim 32, wherein the particulate material is fired at a temperature in the range from 1200° to 1400° C.

36. A thermal cut-out device according to claim 35, wherein the particulate material is fired at a temperature of substantially 1350° C.

37. A thermal cut-out device according to claim 35, wherein the particulate material is fired for a time between substantially 10 minutes and 1 hour.

* * * * *